United States Patent [19]

Goodman

[11] Patent Number: 4,907,397

[45] Date of Patent: Mar. 13, 1990

[54] SHELF PACKER

[75] Inventor: James A. Goodman, Glencoe, Ill.

[73] Assignee: Prototype Equipment Corp., Glencoe, Ill.

[21] Appl. No.: 257,067

[22] Filed: Oct. 13, 1988

Related U.S. Application Data

[62] Division of Ser. No. 47,817, May 8, 1987, Pat. No. 4,815,251.

[51] Int. Cl.[4] ..... B65B 5/10

[52] U.S. Cl. ..... 53/443; 53/156; 53/157; 53/243; 53/540

[58] Field of Search ..... 53/443, 447, 157, 156, 53/154, 150, 474, 475, 537, 540, 536, 531, 238, 237, 392, 243; 493/89

[56] References Cited

U.S. PATENT DOCUMENTS

| | | | |
|---|---|---|---|
| 2,024,503 | 12/1935 | Bickford | 53/392 X |
| 3,470,674 | 10/1969 | Madonia | 53/157 |
| 3,604,184 | 9/1971 | Shuttleworth | 53/157 |
| 3,826,058 | 7/1974 | Preisig | 53/157 X |
| 4,514,956 | 5/1985 | Varallo et al. | 53/157 X |
| 4,584,821 | 4/1986 | Booth | 53/157 X |
| 4,731,977 | 3/1988 | Maekawa | 53/540 X |

FOREIGN PATENT DOCUMENTS

| | | | |
|---|---|---|---|
| 1008170 | 5/1952 | France | 53/156 |

*Primary Examiner*—James F. Coan

*Attorney, Agent, or Firm*—Willian, Brinks, Olds, Hofer, Gilson & Lione

[57] ABSTRACT

An apparatus and process for packing a box with a plurality of groups of pouches or other flexible containers and inserting a support shelf between the groups. A conveyor is used to support and convey boxes such that means for inserting a first group of pouches into a box inserts a group of pouches into the top portion of a box. The boxes are then positioned such that means for inserting a suport shelf into the box inserts a shelf into the box before means for inserting a second group of pouches inserts a second group of pouches into the box. The support shelf is inserted from the bottom of the box such that the first group of pouches is supported above the second group of pouches and the support legs of the support shelf rest on the bottom of the box.

26 Claims, 3 Drawing Sheets

FIG. 1
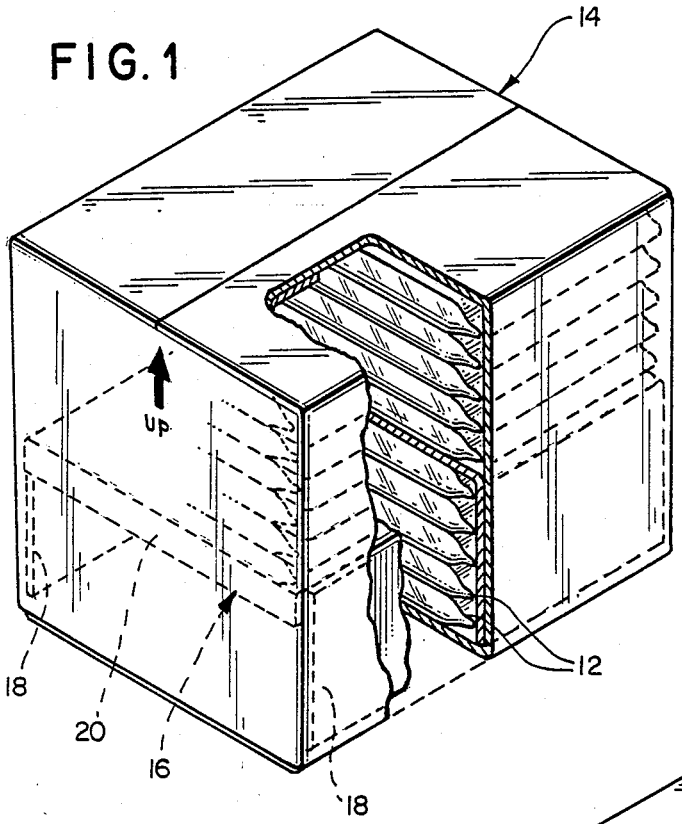
FIG. 2
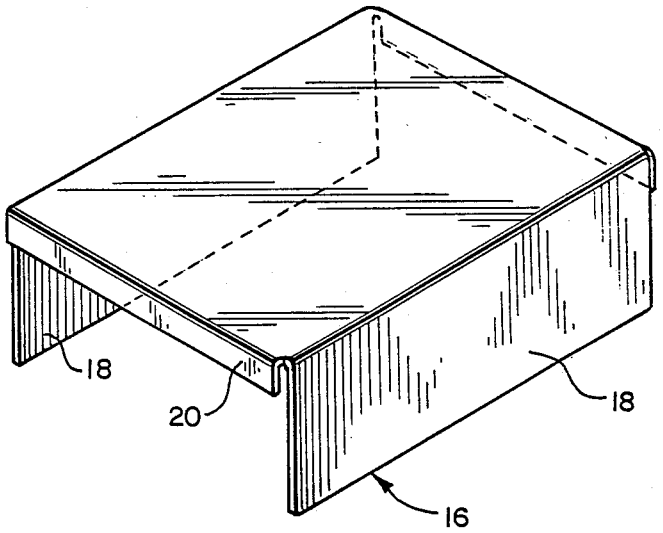
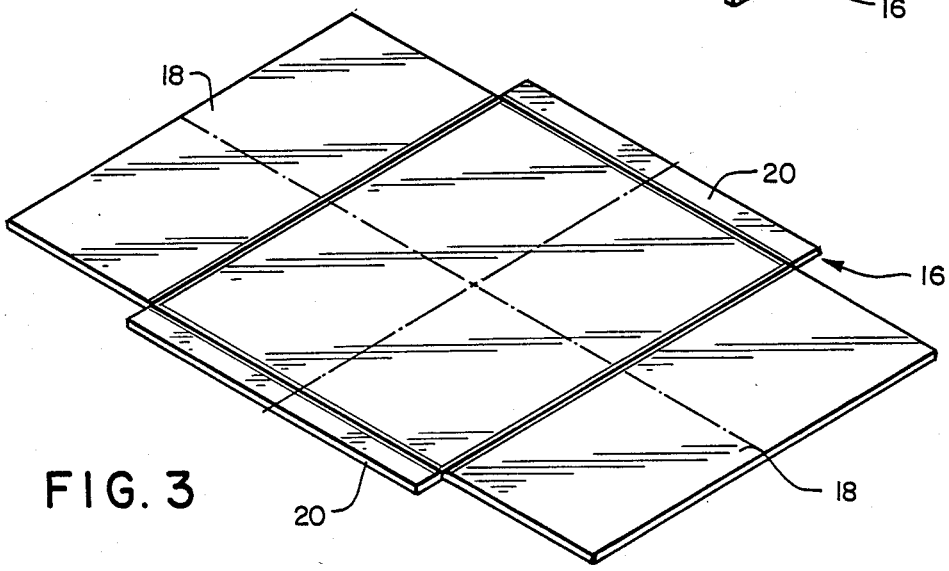
FIG. 3

SHELF PACKER

This is a division of application Ser. No. 047,817, filed May 8, 1987 now U.S. Pat. No. 4,815,251.

BACKGROUND OF THE INVENTION

This invention relates generally to a packing apparatus and method for packing pouches or other flexible containers, and more particularly to a packing machine for packing a plurality of groups of pouches into a box and inserting a shelf between the groups of pouches.

Flexible pouches, formed by crimping and sealing the ends of a tubular section of cellophane, plastic wrap, or foil, are used to prepare such items as nuts, candies, potato chips, other snack foods and a variety of other discrete items for sale to the individual consumer. The advantages of these pouches include lighter weight, lower cost and ease of filling.

Packing boxes or cases with these flexible, irregularly-shaped pouches for shipment so as to avoid crushing the contents of the pouches and still make efficient use of space has proven to be difficult. When a box is fully packed with pouches, the group of pouches in the bottom portion of the box are deformed by the weight of the pouches in the top portion of the box. The deformation of the pouches causes the contents of the pouches in the lower portion of the box to become crushed.

Since the weight of the group of pouches in the top portion of a box causes a majority of the deformation of the group of pouches in the bottom portion of the box, it is desirable to support the pouches in the top portion of the box with a shelf dividing the box substantially in half. Even though a shelf can solve the problem of deformation of the pouches in the lower portion of a box, placing a shelf into a box between the top group of pouches and the bottom group of pouches has inherent problems. One problem is that the insertion of a shelf is normally done manually. Manual insertion of a shelf slows the packing process and thereby increases the expense of the packing process. Another problem is supporting the shelf between the bottom group of pouches and the top group of pouches. Normally a substantially X-shaped or Z-shaped spacer is manually placed between the bottom group of pouches and top group of pouches. The spacer supports the shelf above the bottom group of pouches. The use of a spacer causes further problems in that the pouches must normally be manually packed around the spacer before the shelf is rested upon the spacer. In addition, boxes are normally packed with the top sealed and the bottom open and the use of a spacer makes this type of packing difficult.

SUMMARY OF THE INVENTION

This invention is directed to an apparatus and process for packing a box with a plurality of groups of pouches or other flexible containers and inserting a shelf between the groups.

According to a preferred embodiment of the present invention, the box packing apparatus includes means for inserting a first group of pouches into a box or case, means for inserting a shelf into the box, means for inserting a second group of pouches into a box and means for supporting and conveying boxes. According to another preferred embodiment of the present invention, the method of packing a box includes inserting a first group of pouches into a box, inserting a shelf into the box and inserting a second group of pouches into the box. It should be understood that in some circumstances a group will refer to only one pouch. For example, where only two pouches are packed into a box and the pouches are separated by a support shelf, each pouch will be a group.

One object of the present invention is to provide a box packing apparatus and method which does not require the manual insertion of a shelf between the groups of pouches in a box.

Another object of the present invention is to provide a box packing apparatus and method which does not require the use of a spacer to support the shelf in a box. In particular, the peferred embodiment of the invention inserts a shelf having two support legs into a box. The support legs of the shelf support the shelf and a group of pouches resting upon the shelf above another group of pouches.

One advantage of the present invention is that it reduces the cost of packing pouches into a box and inserting a shelf between groups of pouches. The cost of packing is reduced because the invention does not require the manual insertion of a shelf. Manual insertion of a shelf reduces the speed of the packing process and requires the use of human labor.

Another advantage of the present invention is its ability to pack a box and insert a shelf from the bottom side of the box, wherein the top closure flaps of the box have been sealed before the start of the packing process.

BRIEF DESCRIPTION OF THE DRAWINGS

The novel features which are characteristic of the invention are set forth in the appended claims. The invention itself, together with further objects and advantages will be best understood by reference to the following description of the illustrated embodiment taken in connection with the accompanying drawings, in which:

FIG. 1 is a perspective view of a box packed with two groups of pouches separated by a support shelf;

FIG. 2 is a perspective view of an erected support shelf;

FIG. 3 is a perspective view of a shelf blank used to form the support shelf;

DETAILED DESCRIPTION

Figures 4, 5, 6:
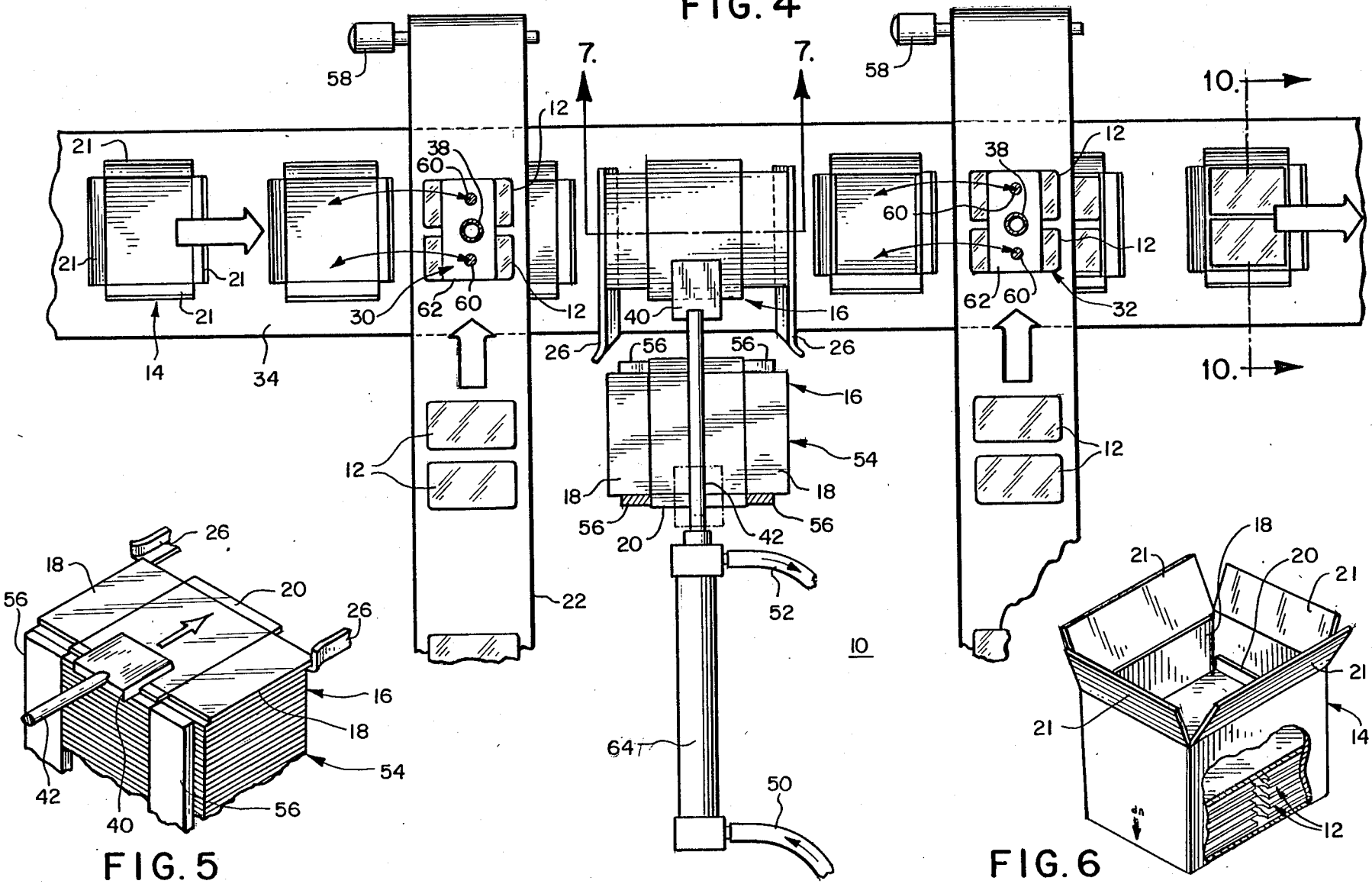
FIG. 4 is a top view of the pouch packing apparatus.
FIG. 5 is a perspective view of a stack of shelf blanks.
FIG. 6 is a perspective view of a box packed with one group of pouches and a support shelf.

Turning now to the drawings, there is shown in FIG. 1 a box 14 packed with two groups of pouches 12 separated by a support shelf 16. The shelf 16 is supported above the bottom group of pouches 12 by two support legs 18. FIG. 3 illustrates a support shelf blank 17 having two support legs 18 and two stiffening legs 20. FIG. 2 illustrates an erected self-supported shelf 16 isolates from the box 14. The support shelf 16 is given additional rigidity by the stiffening legs 20.

There is shown in FIG. 4, as an example of the preferred embodiment of the present invention, a packing machine generally indicated by the reference numeral 10. This packing machine 10 is described below first in terms of its major structural elements and then in terms of its functional elements which cooperate to perform the packing function. The primary structural elements of the packing machine 10 are the means for inserting a support shelf 16 into a box 14, the means for inserting a first group of pouches 12 into the box 14, the means for inserting a second group of pouches 12 into the box 14 and the means for supporting and conveying boxes 14.

Figure 10:
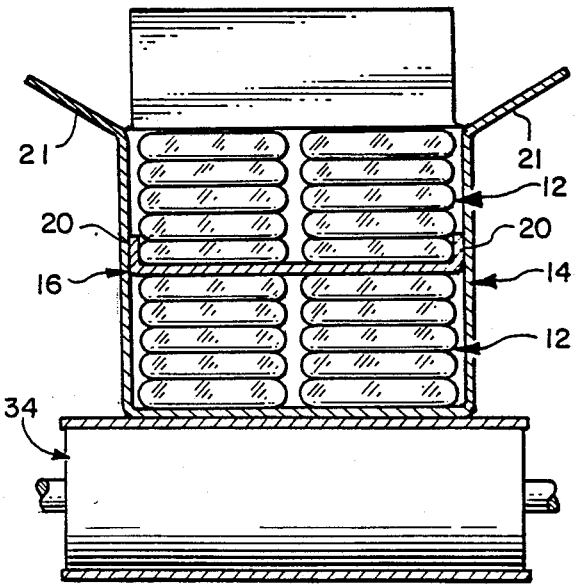
FIG. 10 is an end view of a box packed with two groups of pouches and a support shelf.

FIG. 4 also illustrates the means for supporting and conveying boxes 14, which in the preferred embodiment of the present invention takes the form of a conveyor 34. The conveyor 34 first conveys empty boxes 14, having their bottom closure flaps 21 open to the means for inserting a first group of pouches 12 into the box 14. After the first group of pouches 12 is inserted into a box 14, the box 14 is conveyed to the means for inserting a support shelf 16 into the box 14. The means for inserting a support shelf 16 into the box 14 erects the shelf 16 and inserts it into the box 14. FIG. 6 illustrates a box 14 after a first group of pouches 12 and a support shelf 16 have been inserted into the box 14. Next, the conveyor 34 conveys the box 14 to the means for inserting a second group of pouches 12 into the box 14. FIG. 10 illustrates a box 14 after a first group of pouches 12, a support shelf 16 and a second group of pouches 12 have been inserted into the box 14. Finally, the conveyor 34 conveys the filled box 14 to another process area such as that for sealing the filled box 14.

The means for inserting a first group of pouches 12 into the box 14 and the means for inserting a second group of pouches 12 into the box 14 each include a conveyor 22, 24, and a pouch transfer means 30, 32. As illustrated in FIG. 4, the conveyors 22, 24 position pouches 12 above the conveyor 34 for placement into boxes 14. The conveyor drive motors 58 are controlled such that pouches 12 are positioned below the pouch transfer means 30, 32. The pouch transfer means 30, 32 each include a vacuum head 62 having two vacuum ports 60, a double-acting pneumatic cylinder 38 and a transfer mechanism (not shown). The transfer mechanism is attached to the cylinder 38 and positions the vacuum head 62 above the pouches 12 on the conveyor 22, 24. The cylinder 38 then lowers the vacuum head 62 to the top surface of the pouches 12 where the suction at the vacuum ports 60 grips the pouches 12. After the vacuum ports 60 grip the pouches 12, the cylinder 38 removes the pouches 12 from the conveyors 22, 24 and the transfer mechanism moves the pouches 12 above the box 14, as illustrated in FIG. 4. The cylinder 38 then lowers the pouches 12 into the box 14. Upon placement in the box 14, the vacuum in the ports 60 is released and the grip on the pouches 12 is thereby released.

The means for inserting a support shelf 16 into a box 14 includes a double-acting pneumatic cylinder 64, a shelf gripper 40, a shelf blank supply stack 54, a vacuum head assembly 36, a support leg folder 28, a stiffening leg folder 29 and support leg guides 26. As illustrated in FIG. 4, the shelf packer is located between the means for inserting a first group of pouches 12 into the box 14 and the means for inserting a second group of pouches 12 into the box 14. The box 14 is positioned by the conveyor 34 so that the shelf blank 17 can be inserted into the box 14.

Before the shelf blank 17 is inserted into a box 14 and formed as a support shelf 16, the shelf blank 17 is moved from the shelf blank supply stack 54 and positioned above the box 14. The shelf gripper 40, the double-acting pneumatic cylinder 64 and the shelf guide 26 cooperate to position the shelf blank 17 above the box 14. When air is supplied to the fluid inlet 50 of the cylinder 64 the piston rod 42 causes the engagement flange 66 of the shelf gripper 40 to engage one shelf blank 17 and slide it onto the shelf guides 26 above a box 14. When air is supplied to the fluid outlet 52 of the cylinder 64 the piston rod 42 is retracted and the shelf gripper 40 is repositioned such that it can engage another shelf blank 17 from the supply stack 54.

The supply stack 54 includes four guide posts 56 and a shelf blank advancement means (not shown). The guide posts 56 align the shelf blanks 17 for engagement by the engagement flange 66 of the shelf gripper 40. Each time a shelf blank 17 is removed from the stack 54 the shelf blank advancement means causes the stack 54 of shelf blanks 17 to rise a distance substantially equal to the thickness of one shelf blank 17. (By way of illustration and with no limitations intended, the advancement means can take the form of a linear spring, a group of linear springs or a pneumatic cylinder having control means for controlling the rise of the stack of shelf blanks.)

Figure 7:
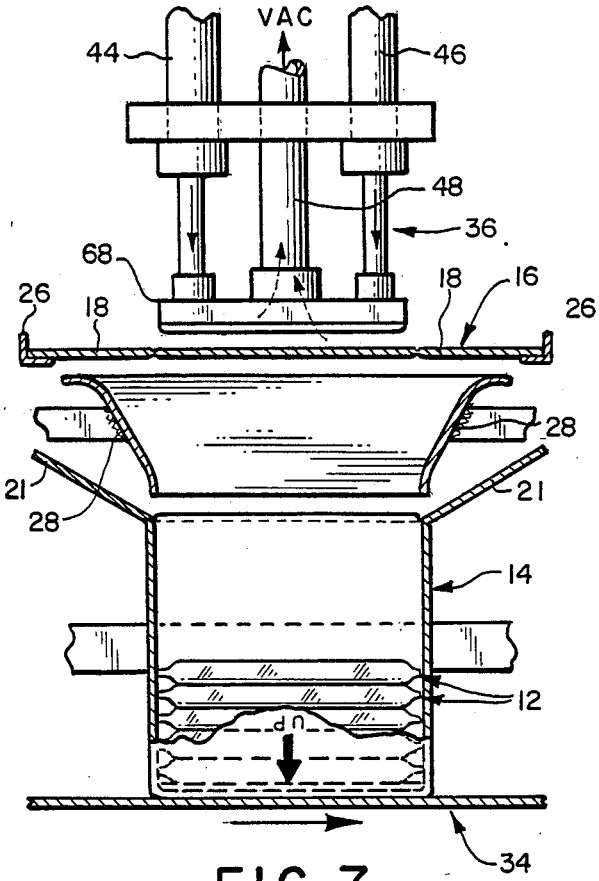
FIG. 7 is a sectional view taken along line 7—7 of FIG. 4.

After a shelf blank 17 is positioned above a box 14, the shelf blank 17 is inserted into the box 14 and formed into a support shelf 16. The vacuum head assembly 36, support leg folder 28, stiffening leg folder 29 and support leg guides 26 cooperate to insert a shelf blank 17 into a box 14 to form a support shelf 16. As illustrated in FIG. 7, the vacuum head assembly 36 is located in its rest position above the location at which a shelf blank 17 is inserted into a box 14. The vacuum head assembly 36 includes a first double-acting pneumatic cylinder 44, a second double-acting pneumatic cylinder 46, a vacuum supply tube 48 and a vacuum head 68.

Figure 8:
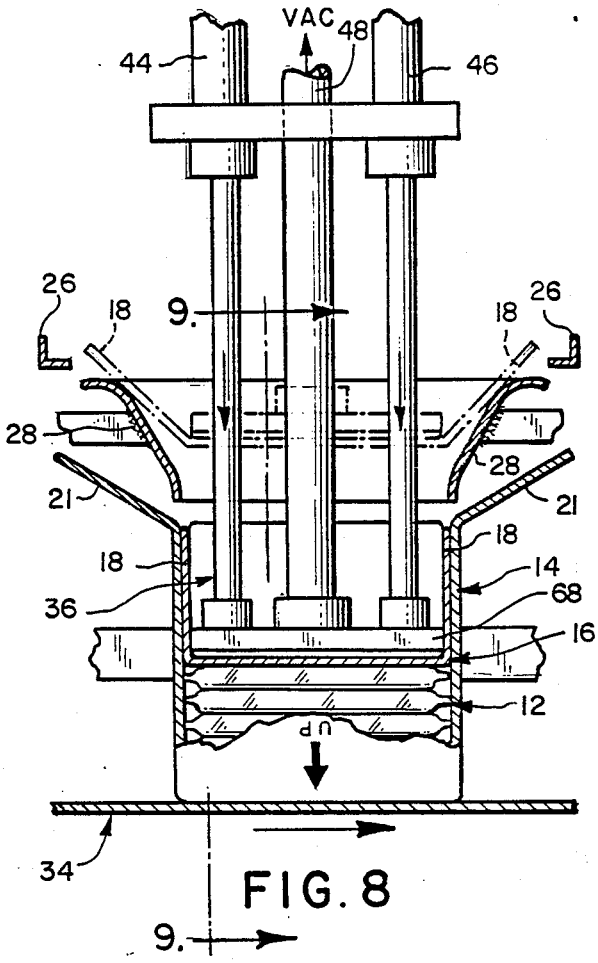
FIG. 8 is a side view of the shelf packer.
Figure 9:
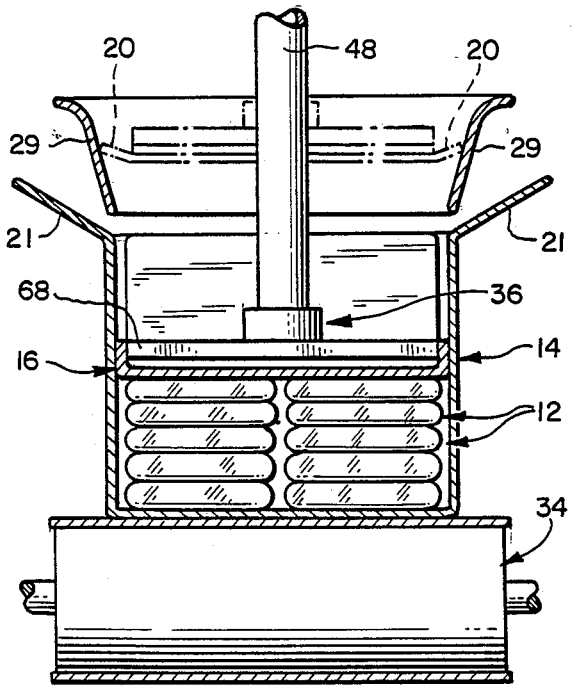
FIG. 9 is a sectional view taken along line 9—9 of FIG. 8.

As illustrated in FIGS. 7, 8 and 9, the shelf blank 17 is inserted to form a support shelf in a box 14 after the first group of pouches 12 is inserted into the box 14. The vacuum head 68 contacts and grips the shelf blank 17 and then forces the shelf blank 17 past the shelf guides 26, support leg folder 28 and the stiffening leg folder 29. The vacuum supplied to the vacuum head 68 by the vacuum supply tube 48 allows the vacuum head 68 to grip the shelf blank 17. The shelf blank 17 is gripped by the vacuum head 68 so that the support shelf 16, when erected and inserted into the box 14, is substantially parallel with the top and bottom surfaces of the box 14.

The preferred embodiment of the process for packing a box 14 with a plurality of groups of pouches 12 or other flexible containers includes inserting a first group of pouches 12 into a box 14, inserting a support shelf 16 into the box 14 and inserting a second group of pouches 12 into the box 14. As illustrated in FIGS. 7 and 8, pouches 12 are first inserted into the top portion of the box 14. After the first group of pouches 12 is inserted into the box 14, the support shelf 16 is inserted into the box 14 followed by the insertion of the second group of pouches 12. The depth of the first group of pouches 12 is such that when the bottom flaps of the box 14 are closed, the support legs 18 of the support shelf 16 rest on the bottom of the box 14 and thereby support the first group of pouches 12 above the second group of pouches 12. (See FIG. 1.)

It should be understood that various changes and modifications to the preferred embodiment described herein will be apparent to those skilled in the art. For example, the pneumatic cylinders 38, 44, 46, 64 could be replaced with hydraulic cylinders or other activating means, or the support shelf 16 could be supported by projections from the sides of the box 14. Such changes and modifications can be made without departing from the scope of the present invention and without diminishing its attendant objectives and advantages. It is therefore intended that such changes and modifications be covered by the following claims.

I claim:

1. A method for packing a box with a plurality of flexible containers and inserting an intermediate self-supporting shelf means in the box to support a portion of the containers in the box, the shelf means including a container-supporting portion, two stiffening legs, and two shelf-supporting legs formed from a shelf blank, by:

orienting the box such that the flexible containers can be inserted into the box;

conveying the pouches by means of a first flexible container conveyor;

gripping and transferring from the first pouch conveyor to the box by means of a first vacuum head mechanism;

gripping a shelf blank by means of a shelf gripped fixed to a free end of a piston rod and pneumatic cylinder arrangement, cooperating with the pneumatic cylinder to move a shelf blank above a box;

gripping a shelf blank by means of a vacuum head;

forming the support legs and guiding the support legs of the shelf means into the box by means of a support leg folder;

inserting the shelf into the box by means of cooperation between the vacuum head, the support leg folder, and a second and a third pneumatic cylinder;

conveying pouches by means of a second pouch conveyor; and gripping and transferring flexible containers from the second flexible container conveyor to the box by means of a second vacuum head mechanism.

2. A method for packing a box with at least two groups of pouches or other flexible containers and inserting a support shelf between the groups comprising:

inserting a first group of pouches into a box;

erecting a support shelf from a shelf blank having at least two support legs and at least two stiffening legs by folding said support legs and stiffening legs;

inserting said support shelf into the box with said support legs and said stiffening legs in said folded condition; and inserting a second group of pouches into the box.

3. The method of claim 2 wherein the pouches and support shelf are inserted from the bottom of a box having the bottom closure flaps open.

4. A method for packing a box with a plurality of flexible containers and inserting an intermediate self-supporting shelf means including a first container-supporting portion and second shelf-supporting leg portions extending transversely from opposed ends of the first portion in the box to support a portion of the containers in the box comprising:

positioning the box having side walls and top and bottom closable ends in a first orientation with the bottom end open;

inserting a first group of containers into the box through the open bottom end with the box in the first orientation to partially fill the box;

inserting the shelf means into the box through the open bottom end in said first orientation into close proximity with said first group of containers such that the second shelf-supporting leg portions extend transversely from opposed ends of the first portion a selected extent toward the open bottom end of the box;

inserting a second group of containers into the box through the open bottom end in said first orientation between the leg portions and onto the container-supporting portion of the shelf means; and closing the open bottom end of the box;

whereby when the box is inverted into a second orientation the closed bottom end of the box engages with the supporting leg portions of the shelf means and the shelf means provides support for the first group of containers in the box independent of the second group of containers.

5. The method of claim 4, further comprising closing the top closable end prior to inserting flexible containers in the box.

6. The method of claim 5, further comprising sealing the top closable end closed prior to inserting flexible containers in the box.

7. The method of claim 4, further comprising extending the shelf-supporting leg portions substantially parallel to opposing side walls of the box.

8. The method of claim 4, further comprising extending the shelf-supporting leg portions substantially adjacent the opposing walls.

9. The method of claim 8, further comprising extending the shelf-supporting leg portions, to, but not beyond, the closable bottom end of the box, once the shelf means is inserted within the box.

10. The method of claim 4, wherein the shelf means is inserted into the box by:

positioning a shelf blank above a box packed with one group of flexible containers; and erecting the shelf means from the shelf blank and inserting the shelf means into the box.

11. The method of claim 10, wherein shelf means is erected from the shelf blank and inserted into the box by:

gripping the shelf blank with a vacuum head attached to a first pneumatic cylinder; and supplying a vacuum to the vacuum head; and inserting the shelf blank gripped by the vacuum head into the box by actuating the pneumatic cylinder.

12. The method of claim 11, further comprising erecting the shelf means from the shelf blank and inserting the shelf means into the box by the pneumatic cylinder, and the vacuum head cooperating with a support leg folder.

13. The method of claim 4, further comprising stiffening the shelf means.

14. The method of claim 13, wherein the shelf means is stiffened by erecting stiffening leg portions along the sides of the container-supporting portion of the shelf means transverse to the shelf-supporting leg portions.

15. The method of claim 14 wherein the shelf means is inserted into the box by:

positioning a shelf blank above a box packed with one group of pouches; and erecting the shelf means from the shelf blank and inserting the shelf means into the box.

16. The method of claim 15, wherein the shelf means is erected from the shelf blank and inserted into the box by:

gripping the shelf blank by means of a vacuum head attached to a first pneumatic cylinder;

supply a vacuum to the vacuum head, and inserting the shelf blank gripped by the vacuum head into the box by actuating the pneumatic cylinder.

17. The method of claim 11, further comprising erecting the shelf means from the shelf blank and inserting the shelf means into the box by cooperation of the pneumatic cylinder, vacuum head, support leg folder and stiffening leg folder.

18. The method of claim 10, wherein the shelf blank is positioned above the box packed with one group of flexible containers by:

gripping shelf blanks on a shelf blank supply using a stack shelf gripper attached to a second pneumatic cylinder;

forcing a shelf blank gripped by the shelf gripper from the shelf blank supply stack onto the shelf guide by actuating said second pneumatic cylinder; and supporting the shelf blank above a box using a shelf guide.

19. The method of claim 18, wherein a first group of flexible containers is inserted into a box by:

gripping the flexible containers using a vacuum head;

delivering flexible containers to the vacuum head using a flexible container conveyor; and inserting flexible containers gripped by the vacuum head into boxes using a transfer mechanism.

20. The method of claim 19, wherein a second group of flexible containers is inserted into a box by:

gripping the flexible containers using a vacuum head;

delivering flexible containers to the vacuum head or a pouch conveyor; and inserting flexible containers griped by the vacuum head into boxes using a transfer mechanism.

21. The method of claim 20, wherein the box is positioned by:

supporting and positioning the box using a conveyor; and driving the conveyor to advance the box to a selected position.

22. A method for packing a box with a plurality of flexible containers and inserting an intermediate self-supporting shelf means in the box to support a portion of the containers in the box, the shelf means including a container-supporting portion, two shelf-supporting legs extending transversely from the container-supporting portion, and stiffening leg portions running perpendicular to the shelf supporting leg portions along the container-supporting portion formed from a shelf blank, comprising:

positioning the box having side walls and top and bottom closable ends in a first orientation with the bottom end open, including using a conveyor;

inserting a first group of containers into the box through the open bottom end with the box in the first orientation to partially fill the box;

positioning the shelf blank above the box packed with the first group of flexible containers;

forcing the shelf blank past a shelf-supporting leg folder and a stiffening leg folder;

inserting the shelf means into the box through the open bottom end in said first orientation into close proximity with said first group of containers;

inserting a second group of containers into the box through the open bottom end in said first orientation between the leg portions and onto the container-supporting portion of the shelf means; and closing the open bottom end of the box;

whereby when the box is inverted into a second orientation the closed bottom end of the box engages with the supporting leg portions of the shelf means and the shelf means provides support for the first group of containers in the box independent of the second group of containers.

23. The method of claim 22, wherein the shelf means is inserted in the box by:

gripping the shelf blank using a vacuum head attached to a first pneumatic cylinder;

supplying a vacuum to the vacuum head; and inserting the shelf blank gripped by the vacuum head through the stiffening leg folder and the support leg folder into the open bottom of the box by actuating the pneumatic cylinder.

24. The method of claim 22, wherein the shelf blank is positioned above a box packed with a first group of pouches by:

gripping shelf blanks from a shelf blank supply stack using a shelf gripper attached to a second pneumatic cylinder;

forcing a shelf blank gripped by the shelf gripper from the shelf blank supply stack onto a shelf guide by actuating the pneumatic cylinders; and supporting the shelf blank above a box or said shelf guide.

25. The method of claim 22, wherein a first group of flexible containers is inserted into a box by:

gripping the flexible containers using a vacuum head;

delivering flexible containers to the vacuum head using a flexible container conveyor; and inserting flexible containers gripped by the vacuum head into boxes using a transfer mechanism.

26. The method of claim 22, wherein a second group of flexible containers is inserted into a box by:

gripping the flexible containers using a vacuum head;

delivering flexible containers to the vacuum head using a flexible container conveyor; and inserting flexible containers gripped by the vacuum head into boxes using a transfer mechanism.

* * * * *

UNITED STATES PATENT AND TRADEMARK OFFICE

CERTIFICATE OF CORRECTION

PATENT NO. : 4,907,397

DATED : March 13, 1990

INVENTOR(S) : James A. Goodman

It is certified that error appears in the above-identified patent and that said Letters Patent is hereby corrected as shown below:

In column 2, line 63, please delete "isolates" and substitute therefor --isolated--.

In claim 1, column 5, line 22, please delete "gripped" and substitute therefor --gripper--.

Signed and Sealed this

Twenty-fourth Day of November, 1992

*Attest:*

*Attesting Officer*

DOUGLAS B. COMER

*Acting Commissioner of Patents and Trademarks*